US010927864B2

(12) United States Patent
Kanazawa et al.

(10) Patent No.: US 10,927,864 B2
(45) Date of Patent: Feb. 23, 2021

(54) FLUID CYLINDER

(71) Applicant: FUJIKURA COMPOSITES INC., Tokyo (JP)

(72) Inventors: Osamu Kanazawa, Saitama (JP); Kenzo Miyamori, Saitama (JP); Keita Kikuchi, Saitama (JP); Yuki Yuasa, Saitama (JP)

(73) Assignee: FUJIKURA COMPOSITES INC., Tokyo (JP)

( * ) Notice: Subject to any disclaimer, the term of this patent is extended or adjusted under 35 U.S.C. 154(b) by 0 days.

(21) Appl. No.: 16/964,232

(22) PCT Filed: Jan. 25, 2018

(86) PCT No.: PCT/JP2018/002322
§ 371 (c)(1),
(2) Date: Jul. 23, 2020

(87) PCT Pub. No.: WO2019/146040
PCT Pub. Date: Aug. 1, 2019

(65) Prior Publication Data

US 2020/0400167 A1 Dec. 24, 2020

(51) Int. Cl.
*F15B 15/02* (2006.01)
*F15B 15/28* (2006.01)

(52) U.S. Cl.
CPC ..... *F15B 15/2815* (2013.01); *F15B 15/02* (2013.01)

(58) Field of Classification Search
CPC ..... F15B 15/02; F15B 15/2815; F15B 15/063
See application file for complete search history.

(56) References Cited

U.S. PATENT DOCUMENTS 4,493,245 A * 1/1985 Kirsch ..... F15B 15/063 91/61
6,098,517 A * 8/2000 Thorwart ..... B25J 9/14 92/121
9,726,204 B2 * 8/2017 Kajinami ..... F15B 15/2846

FOREIGN PATENT DOCUMENTS

DE 32 12 636 A1 10/1983
EP 3 062 427 A2 8/2016
JP H08-232910 A 9/1996
JP H11-201111 A 7/1999
(Continued)

OTHER PUBLICATIONS

International Search Report for PCT/JP2018/002322 dated Apr. 4, 2018.

(Continued)

*Primary Examiner* — Thomas E Lazo
(74) *Attorney, Agent, or Firm* — McCormick, Paulding & Huber PLLC

(57) ABSTRACT

In particular, an object is to provide a fluid cylinder allowing for accurate stroking while causing rotation with reduced power consumption and a compact configuration. The fluid cylinder of the present invention includes a cylinder body and a shaft member supported within the cylinder body and wherein the shaft member is capable of stroking in an axial direction while rotating by means of a fluid. A rotary driver that rotates the shaft member on the basis of a rotation pressure generated by the fluid and a stroke driver that causes the shaft member to stroke on the basis of a cylinder control pressure generated by the fluid are provided in separate areas within the cylinder body.

8 Claims, 3 Drawing Sheets

(56) References Cited

FOREIGN PATENT DOCUMENTS

| | | | |
|---|---|---|---|
| JP | 2005-127486 | A | 5/2005 |
| JP | 2011-69384 | A | 4/2011 |
| JP | 2012-57718 | A | 3/2012 |
| JP | 2017-9068 | A | 1/2017 |
| JP | 2017-133593 | A | 8/2017 |

OTHER PUBLICATIONS

Decision of Patent Grant from Japanese Patent Office for Japanese Patent Application No. 2018-537875 dated Dec. 11, 2018 and its English translation.
English Translation of Notice of Reasons for Refusal from Japanese Patent Office for Japanese Patent Application No. 2018-537875 dated Oct. 1, 2018.

* cited by examiner

FLUID CYLINDER

CROSS-REFERENCE TO RELATED APPLICATION

This application is a National Stage application of International Patent Application No. PCT/JP2018/002322 filed on Jan. 25, 2018, which is hereby incorporated by reference in its entirety.

TECHNICAL FIELD OF THE INVENTION

The present invention relates to a fluid cylinder such as an air-bearing cylinder.

BACKGROUND OF THE INVENTION

The patent documents indicated below describe inventions pertaining to air-bearing cylinders. An air-bearing cylinder includes a cylinder body, a shaft member accommodated within the cylinder body, and an air bearing provided on the outer peripheral surface of the shaft member.

The shaft member is kept floating within the cylinder body by air blown from the air bearing. A cylinder chamber is provided between the cylinder body and the shaft member. The shaft member can stroke in the axial direction on the basis of the supplying/evacuating of air into/from the cylinder chamber.

The shaft member of a conventional air cylinder is rotated using a rotary drive motor, as described in, for example, Japanese Laid-open Patent Publication No. 2011-69384. Japanese Laid-open Patent Publication No. 2012-57718 does not disclose a rotation mechanism for a shaft member.

SUMMARY OF THE INVENTION

However, configurations with a feature of rotating a shaft member by means of a motor as seen in the prior art have involved problems of increased power consumption and inability to appropriately achieve a compact configuration. In particular, use of a motor tends to increase power consumption due to heat generation. In addition, the rotation mechanism will be complicated to mechanically rotate the shaft member and thus cannot be appropriately made compact.

The present invention was created in view of such facts. In particular, an object of the invention is to provide a fluid cylinder allowing for accurate stroking while causing rotation with reduced power consumption and a compact configuration.

The present invention provides a fluid cylinder that includes a cylinder body and a shaft member supported within the cylinder body, wherein the shaft member is capable of stroking in an axial direction while rotating by means of a fluid.

In the present invention, a rotary driver that rotates the shaft member on the basis of a rotation pressure generated by the fluid and a stroke driver that causes the shaft member to stroke on the basis of a cylinder control pressure generated by the fluid are preferably provided in separate areas within the cylinder body.

The present invention is preferably such that: the shaft member includes a piston, a first piston rod provided at a front end of the piston and capable of protruding out of the cylinder body in accordance with the shaft member stroking, a second piston rod provided at a rear end of the piston, and a rotary drive body; the cylinder body has provided therewithin a cylinder chamber into which the piston is capable of being inserted, a first communication section which extends from the cylinder chamber through a portion leading to a front end face of the cylinder body and into which the first piston rod is capable of being inserted, a second communication section which extends from the cylinder chamber toward a rear end and into which the second piston rod is capable of being inserted, and a rotary drive chamber provided in a separate space from the cylinder chamber; the cylinder chamber forms the stroke driver; the rotary drive chamber forms the rotary driver; an axial length dimension of the cylinder chamber is greater than an axial length dimension of the piston; the shaft member is supported to be capable of stroking on the basis of a cylinder control pressure generated within the cylinder chamber by the fluid; the rotary drive body is disposed within the rotary drive chamber; and the shaft member is supported in a rotatable manner by rotating the rotary drive body on the basis of a rotation pressure generated within the rotary drive chamber by the fluid.

The present invention is preferably such that the rotary drive chamber is provided on a rear-end side of the second communication section, the second piston rod extends from the second communication section to the rotary drive chamber, and the rotary drive body is attached to the second piston rod, which is positioned within the rotary drive chamber.

The present invention is preferably such that a position sensor capable of measuring a position of the shaft member in the axial direction is disposed without being in contact with the shaft member.

The present invention is preferably such that a hole is provided in an axial center of the rotary drive body, which is attached to a rear end of the second piston rod, and the position sensor, which is not in contact with the rotary drive body, is disposed in the hole.

The present invention is preferably such that the shaft member includes an air bearing, the cylinder body is provided with an air supply port for blowing air to the air bearing, and the shaft member is supported in a floating state within the cylinder body.

The fluid cylinder of the invention allows for accurate stroking while causing rotation with reduced power consumption and a compact configuration.

DETAILED DESCRIPTION

The following describes an embodiment of the invention (hereinafter, "the embodiment") in detail.

Figure 1:
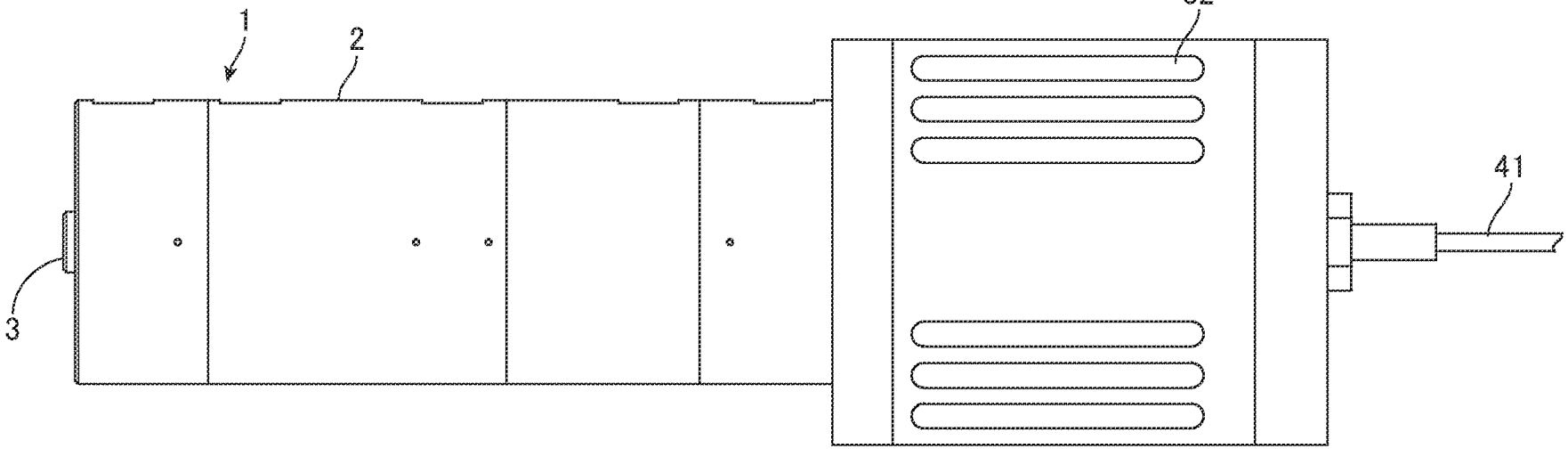
FIG. 1 is an appearance view of a fluid cylinder in accordance with embodiments.
Figure 2:
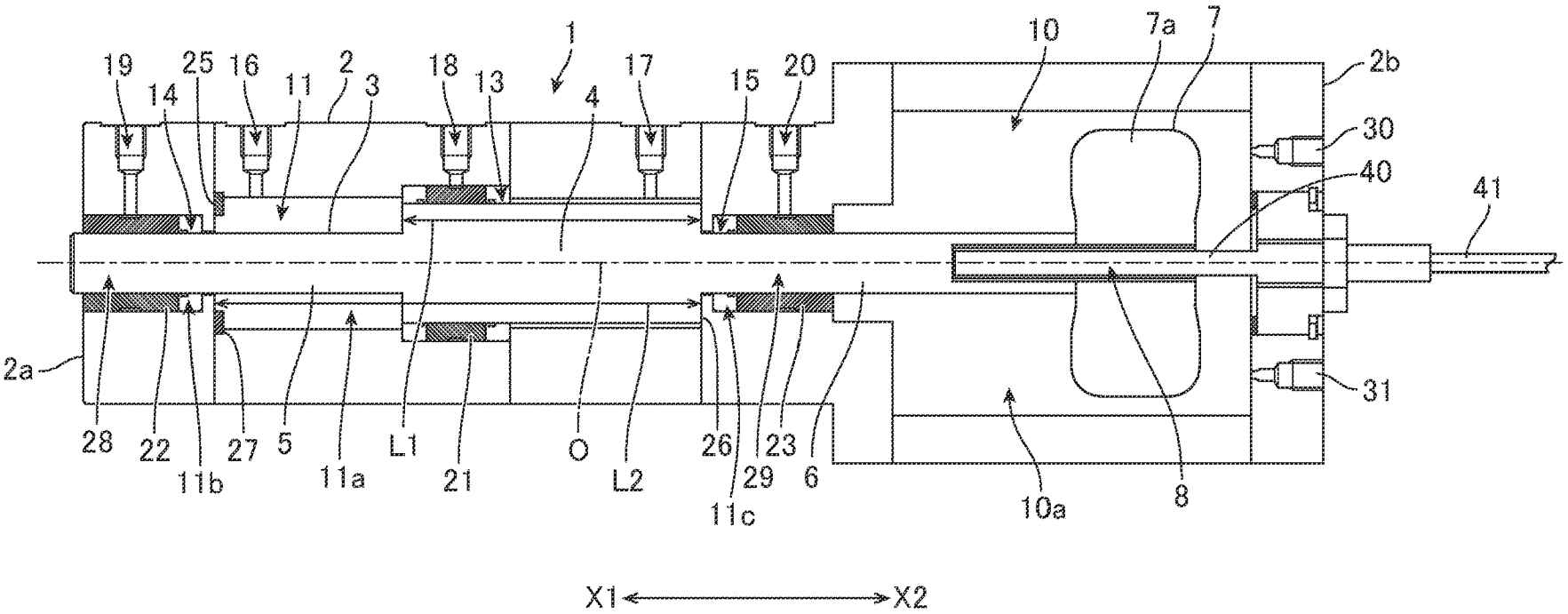
FIG. 2 is a cross-sectional view of a fluid cylinder in accordance with embodiments.
Figure 3:
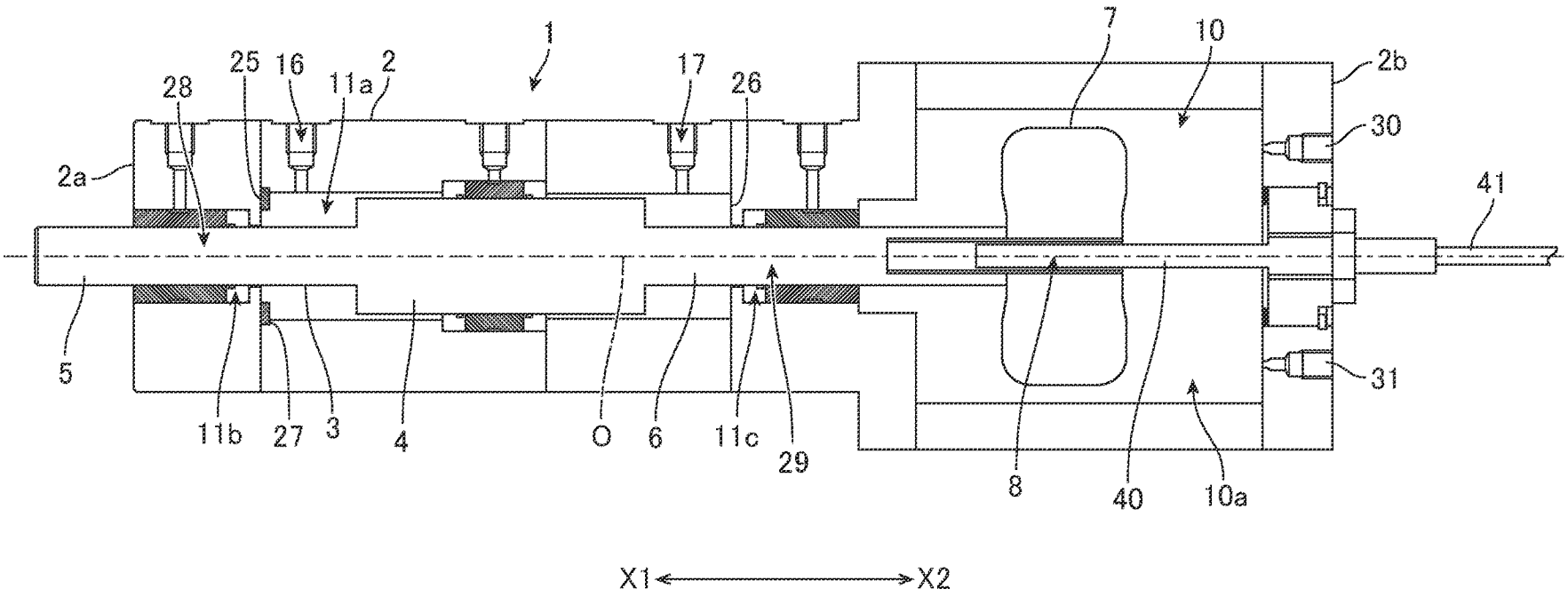
FIG. 3 is a cross-sectional view illustrating a fluid cylinder in accordance with embodiments in a state of forward stroke.

A fluid cylinder 1 depicted in FIGS. 1-3 includes a cylinder body 2 and a shaft member 3 supported within the cylinder body.

The fluid cylinder 1 in accordance with the embodiment allows the shaft member 3 to stroke in an axial direction while rotating by means of a fluid. "Rotation" indicates rotating with an axial center O of the shaft member 3 (see FIG. 2) as a center of rotation. "Stroke" indicates that the shaft member 3 moves in a X1-X2 direction depicted in FIG. 2. A X1 direction is a direction toward a front portion of the fluid cylinder 1, and a X2 direction is a direction toward a rear portion of the fluid cylinder 1. The state of stroke in FIG. 3 indicates a state in which the shaft member 3 has moved forward with reference to the state in FIG. 2.

In the embodiment, as described above, a fluid serves to allow for both rotation of the shaft member 3 and stroke of the shaft member 3. In the prior art, there have been no fluid cylinders that control both rotation of the shaft member 3 and stroke of the shaft member 3 by means of a fluid. In the embodiment, the shaft member 3 is capable of stroking while rotating by means of a fluid, so that accurate rotational stroke can be attained with reduced power consumption and a compact configuration, in comparison with, for example, configurations in which rotation of a shaft member is controlled in a motor-driven manner as seen in the prior art.

The following describes a specific configuration of the fluid cylinder 1 in accordance with the embodiment. In the embodiment, a "fluid" is not limited to air and may be a liquid, and the rotation of the shaft member 3 and the stroke of the shaft member 3 may be controlled by means of different types of fluids. The following embodiment is described with reference to an air-bearing cylinder that allows the shaft member 3 to stroke while rotating by means of air.

The shaft member 3 in the embodiment includes: a piston 4 having a predetermined diameter and a predetermined length dimension L1 in the X1-X2 direction (see FIG. 2); a first piston rod 5 provided on a front end face of the piston 4 and having a smaller diameter than the piston 4; and a second piston rod 6 provided on a rear end face of the piston 4 and having a smaller diameter than the piston 4. As depicted in FIG. 2, the piston 4, the first piston rod 5, and the second piston rod 6 are integral. As depicted in FIG. 2, the axial centers of the piston 4, the first piston rod 5, and the second piston rod 6 are aligned on a straight line. The diameter of the first piston rod 5 and the diameter of the second piston rod 6 are equal in this embodiment but may be different from each other.

As depicted in FIG. 2, a rotary drive body 7 is attached on a rear-end side of the second piston rod 6 of the shaft member 3. Although the structure of the rotary drive body 7 is not limited, the rotary drive body 7 in FIG. 2 is formed with, for example, rotating blades (turbine) constituted by a plurality of blades 7*a* arranged at equal angles. As long as the rotary drive body 7 can rotate by means of a fluid, this body may be a structure other than rotating blades.

As depicted in FIG. 2, a hole 8 extends from the axial center of the rotary drive body 7 to the inside of the rear end portion of the second piston rod 6.

A rotary driver 10 for rotating the shaft member 3 on the basis of the rotation pressure of air and a stroke driver 11 for causing the shaft member 3 to stroke on the basis of the cylinder control pressure of air are provided in separate areas within the cylinder body 2 depicted in FIG. 2. The stroke driver 11 is provided in a front portion of the cylinder body 2 (X1), and the rotary driver 10 is provided in a rear portion of the cylinder body 2 (X2). Owing to the rotary driver 10 and the stroke driver 11 being provided in separate areas as described above, when airflows are concurrently applied to the rotary driver 10 and the stroke driver 11, the shaft member 3 can accurately stroke while rotating without the airflows being mixed.

The stroke driver 11 includes: a cylinder chamber 11*a* which is positioned within the cylinder body 2 and into which the piston 4 of the shaft member 3 is capable of being inserted; and air ports 16 and 17 leading from the outer peripheral surface of the cylinder body 2 to the cylinder chamber 11*a*.

The rotary driver 10 includes a rotary drive chamber 10*a* positioned within the cylinder body 2 and air ports 30 and 31 leading from a rear end face 2*b* of the cylinder body 2 into the rotary drive chamber 10*a*.

As depicted in FIG. 2, a first communication section 28 which extends from the cylinder chamber 11*a* through a portion leading to a front end face 2*a* of the cylinder body 2 and into which the first piston rod 5 is capable of being inserted and a second communication section 29 which extends from the cylinder chamber 11*a* toward the rear end (X2) and into which the second piston rod 6 is capable of being inserted are formed within the cylinder body 2 as spaces continuous with the cylinder chamber 11*a*.

The cylinder chamber 11*a* is an essentially cylindrical space having a slightly larger diameter than the piston 4 and has a length dimension L2 in the X1-X2 direction. The length dimension L2 is greater than the length dimension L1 of the piston 4. A central air-bearing space 13 having a large diameter is provided in the cylinder chamber 11*a* at the center of the length dimension L2 in the X1-X2 direction. The central air-bearing space 13 is provided at a position such that the piston 4 is not taken out even when the piston 4 is moved to a limit in the X1-X2 direction within the cylinder chamber 11*a*. Accordingly, a portion of the piston 4 is always located within the central air-bearing space 13.

As depicted in FIG. 2, the cylinder body 2 is provided with the air port 16, which is located on a front side of the cylinder chamber 11*a* (X1) and leading from the outer peripheral surface of the cylinder body 2 to the cylinder chamber 11*a*. The cylinder body 2 is also provided with the air port 17, which is located on a rear side of the cylinder chamber 11*a* (X2) and leading from the outer peripheral surface of the cylinder body 2 to the cylinder chamber 11*a* (X2). The interval between the centers of the air ports 16 and 17 is greater than the length dimension L1 of the piston 4.

As depicted in FIG. 2, the cylinder body 2 is provided with an air-bearing pressurization port 18 located between the air ports 16 and 17 and leading from the outer peripheral surface of the cylinder body 2 to the central air-bearing space 13.

As depicted in FIG. 2, the first communication section 28 is provided with a front air-bearing space 14 at a position away from and forward (X1) of the cylinder chamber 11*a*. The second communication section 29 is provided with a rear air-bearing space 15 at a position away from and rearward (X2) of the cylinder chamber 11*a*, as depicted in FIG. 2.

An air-bearing pressurization port 19 leading from the outer peripheral surface of the cylinder body 2 to the front air-bearing space 14 is provided as depicted in FIG. 2. An air-bearing pressurization port 20 leading from the outer peripheral surface of the cylinder body 2 to the rear air-bearing space 15 is provided as depicted in FIG. 2.

As depicted in FIG. 2, an air bearing 21 is located within the central air-bearing space 13 and surrounds the outer circumference of the piston 4. An air bearing 22 is located within the front air-bearing space 14 and surrounds the outer circumference of the first piston rod 5, as depicted in FIG. 2. An air bearing 23 is located within the rear air-bearing space 15 and surrounds the outer circumference of the second piston rod 6, as depicted in FIG. 2.

The type of the air bearings 21-23 is not limited. For example, ring-shaped bearings comprising porous materials using sintered metal or carbon or bearings of an orifice throttle type may be used as the air bearings 21-23.

Compressed air is supplied to the air-bearing pressurization ports 18-20 so as to be blown equally to the surfaces of the piston 4, first piston rod 5, and second piston rod 6 through the air bearings 21-23. Accordingly, the piston 4, the first piston rod 5, and the second piston rod 6 are respectively supported in a floating state within the cylinder chamber 11*a*, a first insertion section 11*b*, and a second insertion section 11*c*. With such a state, the supplying/evacuating of air into/from the air ports 16 and 17 leading to the cylinder chamber 11*a* may be utilized to generate a differential pressure in the cylinder chamber 11*a*, and the cylinder control pressure may be adjusted so that the piston 4 can stroke in the axial direction. Although not illustrated, the cylinder control pressure may be appropriately adjusted by a servo valve leading to the air ports 16 and 17. In FIG. 2, the piston 4 is located most rearward within the cylinder chamber 11*a* (position furthest on the X2 side). Thus, the cylinder chamber 11*a* includes an empty space forward of the piston 4, as depicted in FIG. 2. With respect to the state depicted in FIG. 2, air within the cylinder chamber 11*a* may be aspired through the air port 16 by means of the servo valve while supplying compressed air into the cylinder chamber 11*a* through the air port 17 by means of the servo valve, thereby generating a differential pressure within the cylinder chamber 11*a* so that the piston 4 can be moved forward (X1), as depicted in FIG. 3. Accordingly, the first piston rod 5 can protrude forward from the front end face 21*a* of the cylinder body 2. With respect to the stroke state depicted in FIG. 3, air within the cylinder chamber 11*a* may be aspired through the air port 17 by means of the servo valve while supplying compressed air into the cylinder chamber 11*a* through the air port 16 by means of the servo valve, thereby supplying compressed air into the cylinder chamber 11*a* so that the piston 4 can be moved rearward (X2).

In this case, the shaft member 3 strokes while remaining in a floating state within the cylinder body 2 and thus can attain a sliding resistance of 0 in the stroking, so that accurate stoke can be performed.

As depicted in FIGS. 2 and 3, a front wall 25 is provided between the cylinder chamber 11*a* and the first insertion section 11*b* within the cylinder body 2. The front wall 25 is a restriction face for restricting the forward (X1) movement of the piston 4, and the piston 4 cannot move forward beyond the front wall 25. As depicted in FIGS. 2 and 3, a rear wall 26 is provided between the cylinder chamber 11*a* and the second insertion section 11*c* within the cylinder body 2. The rear wall 26 is a restriction face for restricting the rearward (X2) movement of the piston 4, and the piston 4 cannot move rearward beyond the rear wall 26. Owing to the rear wall 26, the stroke driver 11 and the rotary driver 10 are provided in separate areas.

As depicted in FIGS. 2 and 3, the front wall 25 is provided with an elastic ring 27. The elastic ring 27 serves as a cushioning material when the piston 4 comes into contact with the front wall 25. Similarly, the rear wall 26 may be provided with an elastic ring.

As depicted in FIGS. 2 and 3, the rotary driver 10 provided in a rear area in the cylinder body 2 (X2) includes the rotary drive chamber 10*a* in which the rotary drive body 7, which is attached to a rear end portion of the second piston rod 6, can be disposed. The rear end portion of the second piston rod 6 extends to the rotary drive chamber 10*a*. The rear end portion of the second piston rod 6 and the rotary drive body 7 are located within the rotary drive chamber 10*a*. The rotary driver 10 also includes the air ports 30 and 31 for supplying compressed air from the rear end face 2*b* of the cylinder body 2 into the rotary drive chamber 10*a*. Compressed air may be supplied from the air ports 30 and 31 into the rotary drive chamber 10*a* so as to apply a rotation pressure to the rotary drive body 7, so that the rotary drive body 7 can rotate. As a result, the entirety of the shaft member 3 that includes the rotary drive body 7 can be axially rotated. Air discharge ports 32 are provided on the outer peripheral surface of the rotary drive chamber 10*a*, as depicted in FIG. 1.

As depicted in FIGS. 2 and 3, the hole 8 extending from the axial center of the rotary drive body 7 to the inside of the rear end portion of the second piston rod 6 has provided therewithin a position sensor (stroke sensor) 40 that is not in contact with the rotary drive body 7 or the second piston rod 6. In the embodiment depicted in FIGS. 2 and 3, the position of the piston 4 may be indirectly measured by using the position sensor 40 disposed in the hole 8 so as to measure the position of the rotary drive body 7 or the position of the rear end of the second piston rod 6 within the hole 8. An existing sensor may be used as the position sensor 40, and for example, a magnetic sensor, an overcurrent sensor, or an optical sensor may be used.

The depth of the hole 8 and the position of the position sensor 40 are decided on in such a manner as to allow for position measurement within a moving range of the piston 4 in the X1-X2 direction. As indicated in FIGS. 2 and 3, position information measured by the position sensor 40 is transmitted to a control unit (not illustrated) via a cable 41.

On the basis of the position information measured by the position sensor 40, the cylinder control pressure within the cylinder chamber 11*a* may be adjusted to control the amount of protrusion of the first piston rod 5.

The present invention is not limited to the embodiments described above and can be implemented with various changes made thereto. The above-described embodiments are not limited to the sizes, shapes, or the like illustrated in the attached drawings and can have changes made thereto, as appropriate, as long as the effect of the invention can be achieved. In addition, the invention can be implemented with changes made thereto, as appropriate, without deviating from the scope of the objects of the invention.

The shaft member 3 in embodiments includes, for example, the piston 4, the first piston rod 5 formed integrally with and located forward of the piston 4, and the second piston rod 6 formed integrally with and located rearward of the piston 4. However, the shape of the shaft member 3 is not limited to this.

However, the piston rods 5 and 6 may be disposed at both ends of the piston 4, so that the amount of stroke can be appropriately adjusted by performing position control with reference to the piston 4, so that the first piston rod 5 can be used as a shaft part supported to be capable of being moved to or retracted from the front end face 2*a* of the cylinder body 2, and so that the rotary drive body 7 can be attached on the second-piston-rod-6 side.

In embodiments, the rotary drive body 7 is not necessarily attached to the second piston rod 6. However, the rotary drive body 7 may be attached on the rear-end side of the second piston rod 6 so as to facilitate the achievement of a compact configuration with accurate rotational stroke.

The position of the position sensor 40 is not limited to the arrangements depicted in FIGS. 2 and 3, and the position sensor 40 may be positioned such that the positions of the first piston rod 5 and the piston 4 can be directly measured. The position sensor 40 may be positioned within the rotary drive chamber 10*a* in a manner such that this sensor can measure the positions of the second piston rod 6 and the rotary drive body 7, rather than being disposed in the hole 8 extending from the axial center of the rotary drive body 7 to the inside of the rear end portion of the second piston rod 6.

However, the position sensor 40 may be disposed, as depicted in FIGS. 2 and 3, in the hole 8 extending from the axial center of the rotary drive body 7 to the inside of the rear end portion of the second piston rod 6, so that the position sensor 40 can be easily positioned and the achievement of a compact configuration can be facilitated while enhancing the accuracy in position measurement.

The cylinder body 2 may be formed by assembling a plurality of separate components as depicted in FIG. 1 or may be an integrated body.

For example, the cylinder body 2 and the shaft member 3 may be formed from an aluminum alloy. However, the material for these components are not limited and can be variously changed according to how these components are to be used, where these components are to be installed, or the like.

In embodiments, the fluid cylinder 1 is, as described above, not limited to an air-bearing cylinder and can be driven by means of a non-air fluid. For example, a hydraulic cylinder may be presented as an example.

The present invention can achieve a fluid cylinder that allows for stroking while causing rotation by means of a fluid. In comparison with the conventional ball bearings, the present invention is such that reduced shaking and accurate rotational stroke can be attained and driving operations are performed by means of a fluid alone, thereby achieving low power consumption and a simple configuration. Therefore, the fluid cylinder of the present invention can be applied to, for example, applications in which highly accurate rotational stroke is required to be attained, so as to achieve reduced power consumption and a compact configuration along with high accuracy.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A fluid cylinder comprising:

a cylinder body; and a shaft member supported within the cylinder body, wherein the shaft member is capable of stroking in an axial direction while rotating by means of a fluid, wherein the shaft member is provided with rotating blades, and wherein the shaft member having the rotating blades rotates by means of the fluid blowing against the rotating blades.

2. The fluid cylinder of claim 1, wherein the shaft member is supported in a floating state within the cylinder body.

3. The fluid cylinder of claim 1, wherein the cylinder body includes a rotary drive chamber in which the rotating blades are provided, and wherein the rotary drive chamber forms a space therein to allow a stroke of the rotating blades in an axial direction.

4. The fluid cylinder of claim 3, wherein the rotary drive chamber is provided with a port, through which the fluid is supplied into the rotary drive chamber, and with a discharge port, through which the fluid is discharged from the rotary drive chamber.

5. The fluid cylinder of claim 1, wherein the shaft member is allowed to do a stroke thereof, in a forward direction, in a manner that the shaft member protrudes from the cylinder body, and wherein the rotating blades are mounted on a rear end of the shaft member.

6. The fluid cylinder of claim 1, wherein the shaft member includes an air bearing, and wherein the cylinder body is provided with an air supply port for blowing air to the air bearing.

7. A fluid cylinder comprising:

a cylinder body; and a shaft member supported within the cylinder body, wherein the shaft member is capable of stroking in an axial direction while rotating by means of a fluid, wherein the shaft member is provided with a rotary drive body, wherein the cylinder body is provided with a position sensor which is capable of measuring a position of the shaft member in an axial direction, and which is positioned, in a non-contacting state, with respect to the shaft member, wherein the shaft member is allowed to do a stroke thereof, in a forward direction, in a manner that the shaft member protrudes from the cylinder body, wherein the shaft member is provided with a hole which is formed in the shaft member along the central axis thereof and is open at a rear end face of the shaft member, and wherein the position sensor, which is in a non-contacting state with respect to the rotary drive body, is provided in the hole.

8. The fluid cylinder of claim 7, wherein the shaft member includes an air bearing, and wherein the cylinder body is provided with an air supply port for blowing air to the air bearing.

* * * * *